US006427291B1

(12) United States Patent
Kim

(10) Patent No.: US 6,427,291 B1
(45) Date of Patent: Aug. 6, 2002

(54) BUCKLE

(76) Inventor: Geun-Sik Kim, 301-ho, Ra-dong, Yeonhee Villa, 685-72, Bongcheon-1dong, Gwanak-gu, Seoul (KR)

( * ) Notice: Subject to any disclaimer, the term of this patent is extended or adjusted under 35 U.S.C. 154(b) by 0 days.

(21) Appl. No.: 09/772,663

(22) Filed: Jan. 30, 2001

(51) Int. Cl.[7] ..... A44B 11/25

(52) U.S. Cl. ..... 24/191; 24/163 R; 24/170

(58) Field of Search ..... 27/191, 192, 170, 27/163 R

(56) References Cited

U.S. PATENT DOCUMENTS 1,388,623 A * 8/1921 Walker ..... 24/163 R
3,913,977 A * 10/1975 Takada ..... 297/388
5,291,638 A * 3/1994 Huang ..... 24/170
5,806,145 A * 9/1998 Chen ..... 24/191
6,148,485 A * 11/2000 Wu ..... 24/163 R

* cited by examiner

*Primary Examiner*—Victor Sakran
(74) *Attorney, Agent, or Firm*—Morgan & Finnegan, L.L.P.

(57) ABSTRACT

The present invention relates to a buckle of the belt which is equipped with saw-toothed coupling means. The present invention provides a buckle comprising a buckle body from the back of which top and bottom walls of buckle frame forming coupling holes are projected on the opposite points; an operating rod which is inserted into the coupling holes formed on top and bottom walls of the buckle frame, wherein a cutout locking member, a locking knob coupled to saw-toothed grooves of a belt, and a push knob for releasing the coupling state of the locking knob are formed on the circumferential surface, a fixed shaft is formed on one end portion, and a spring locking portion is equipped inside thereof; a fixed rod which is coupled to one end portion of the operating rod, wherein a blocking projection inserted into the cutout locking member of the operating rod is formed on the circumferential surface, a fixed rectangular protrusion is formed on one end portion, and a spring locking portion is equipped inside thereof; and a spring for providing the operating rod with rotating elasticity by being inserted into the operating rod.

A buckle according to the present invention is more useful compared to, the buckles according to the prior art in that it has made both functions of fastening and unfastening of a belt realized in one component, thereby decreasing numbers of component parts of a buckle and simplifying structure thereof such that production cost can be reduced, productivity can greatly be improved, and unfastening of a belt contrary to a user's intention can be prevented.

1 Claim, 3 Drawing Sheets

BUCKLE

BACKGROUND OF THE INVENTION (a) Field of the Invention

The present invention relates to a buckle of a belt which is equipped with saw-toothed coupling means, and more particularly to a buckle, wherein a locking member formed on the back side of the buckle is locked with saw-toothed coupling grooves which are continuously formed longitudinally along the center of the back side of the belt such that the belt can be fastened at random points.

(b) Description of the Related Art

As a buckle which has been conventionally used, "a belt equipped with saw-toothed coupling means" is disclosed in Korean Utility Model Publication No. 96-4268.

Coupling means of the above conventional buckles is constructed in a way that a saw-toothed member having plurality of narrowly spaced saw teeth is sticked to a waist belt, an inclined guiding groove is integrally formed on the external surface of a cylindrical operating rod forming a locking member of which end portion is locked with the saw teeth on the circumferential surface thereof, a spring is built-in thereby fixed by a bolt in the upper part of a housing which is coupled to the operating rod side by side in the body of an ornamented belt, a push rod which is equipped with a projection coupled to the inclined guiding groove of the operating rod and of which knob is exposed downwardly through a rectangular groove of the body of a buckle is forced to receive downward elasticity by the spring inside the housing such that end portion of the locking member is normally locked with a saw-toothed member, and the spring is pressed causing the locking member rotate by the downwardly moving the push rod, thus releasing the locking state of the saw-toothed member to unfasten a belt when a knob which is formed on end portion of the push rod is pressed.

The above conventional buckles consist of an ornament, an operating rod, a housing, a spring, a push rod, etc. Production process has been complicated, workability in the assembly process has been dropped, and production costs have been increased due to their complicated structure and numerous components.

Furthermore, the knob is pressed against by touching with the abdominal region of a user, thereby causing unfastening of a belt contrary to a user's intention, severe problems during using when a user is seated in the state of wearing a belt since a knob for releasing the locking state of a belt is formed on the lower part of a buckle.

SUMMARY OF THE INVENTION

The present invention was invented so as to solve the problems which buckles according to the prior art have. Therefore, it is an object of the present invention to provide a buckle which simplifies production process, reduces production costs by decreasing number of components, improves productivity of a worker by simplifying the structure thereof, and can prevent unfastening of a belt contrary to a user's intention before it happens.

In order to achieve the above object, the present invention provides a buckle comprising:

a buckle body from the back of which top and bottom walls of buckle frame forming coupling holes are projected on the opposite points;

an operating rod which is inserted into the coupling holes formed on top and bottom walls of the buckle frame, wherein a cutout locking member, a locking knob coupled to saw-toothed grooves of a belt, and a push knob for releasing the coupling state of the locking knob are formed on the circumferential surface, a fixed shaft is formed on one end portion, and a spring locking portion is equipped inside thereof;

a fixed rod which is coupled to one end portion of the operating rod, wherein a blocking projection inserted into the cutout locking member of the operating rod is formed on the circumferential surface, a fixed rectangular protrusion is formed on one end portion, and a spring locking portion is equipped inside thereof; and a spring for providing the operating rod with rotating elasticity by being inserted into the operating rod.

A buckle according to the present invention is characterized in that it has made functions of fastening and unfastening of a belt realized in one component, thereby decreasing number of components and simplifying structure thereof such that productivity can be improved while buckles according to the prior art are characterized in that an operating rod for fastening a belt is systematically united with a housing for releasing the fastened state of the belt.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention. In the drawings.

DETAILED DESCRIPTION OF A PREFERRED EMBODIMENT

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

The present invention is described in detail as follows according to the enclosed drawings.

Figure 1:
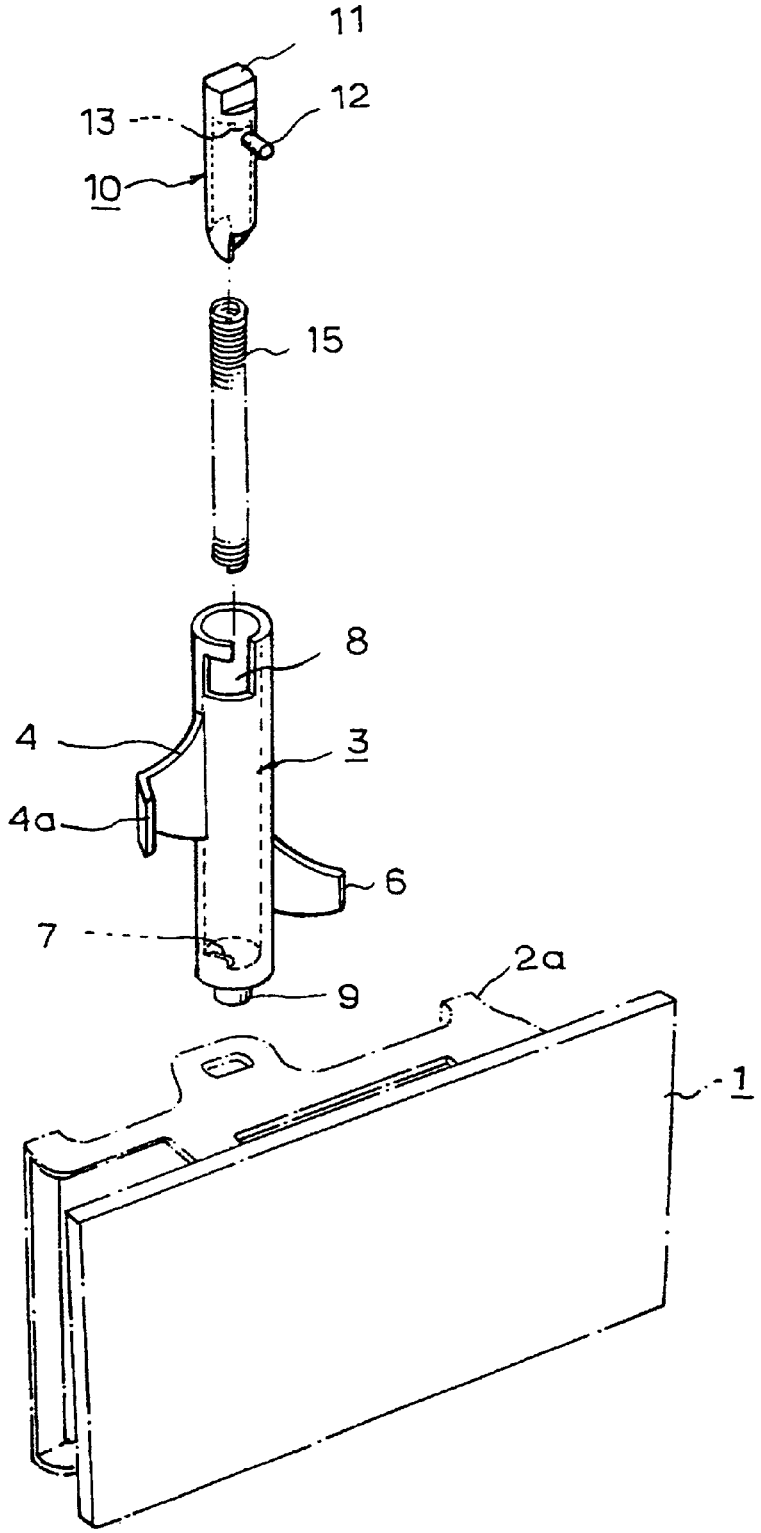
FIG. 1 is a disassembling perspective view of a major part of the present invention.
Figure 2:
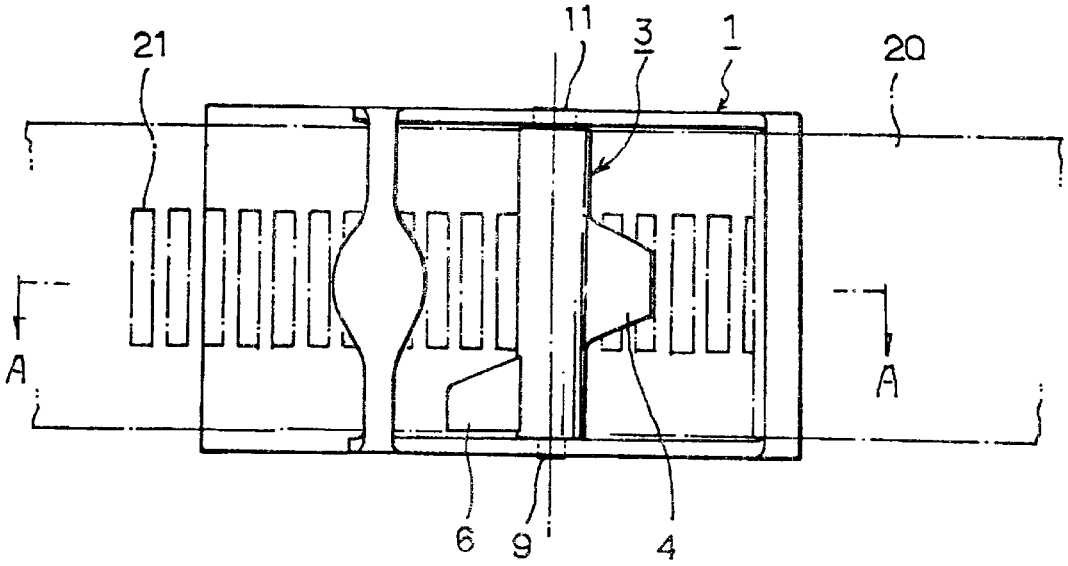
FIG. 2 is a rear view showing the used state of the present invention.
Figure 3:
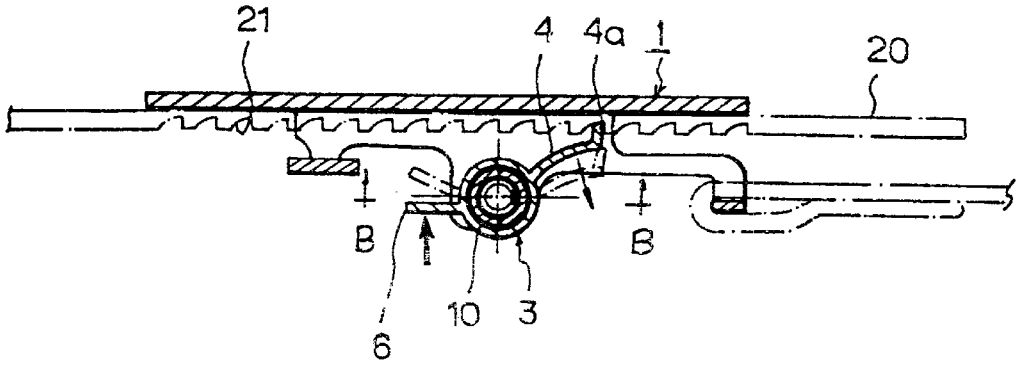
FIG. 3 is a sectional view taken along line A—A in FIG. 2.
Figure 4:
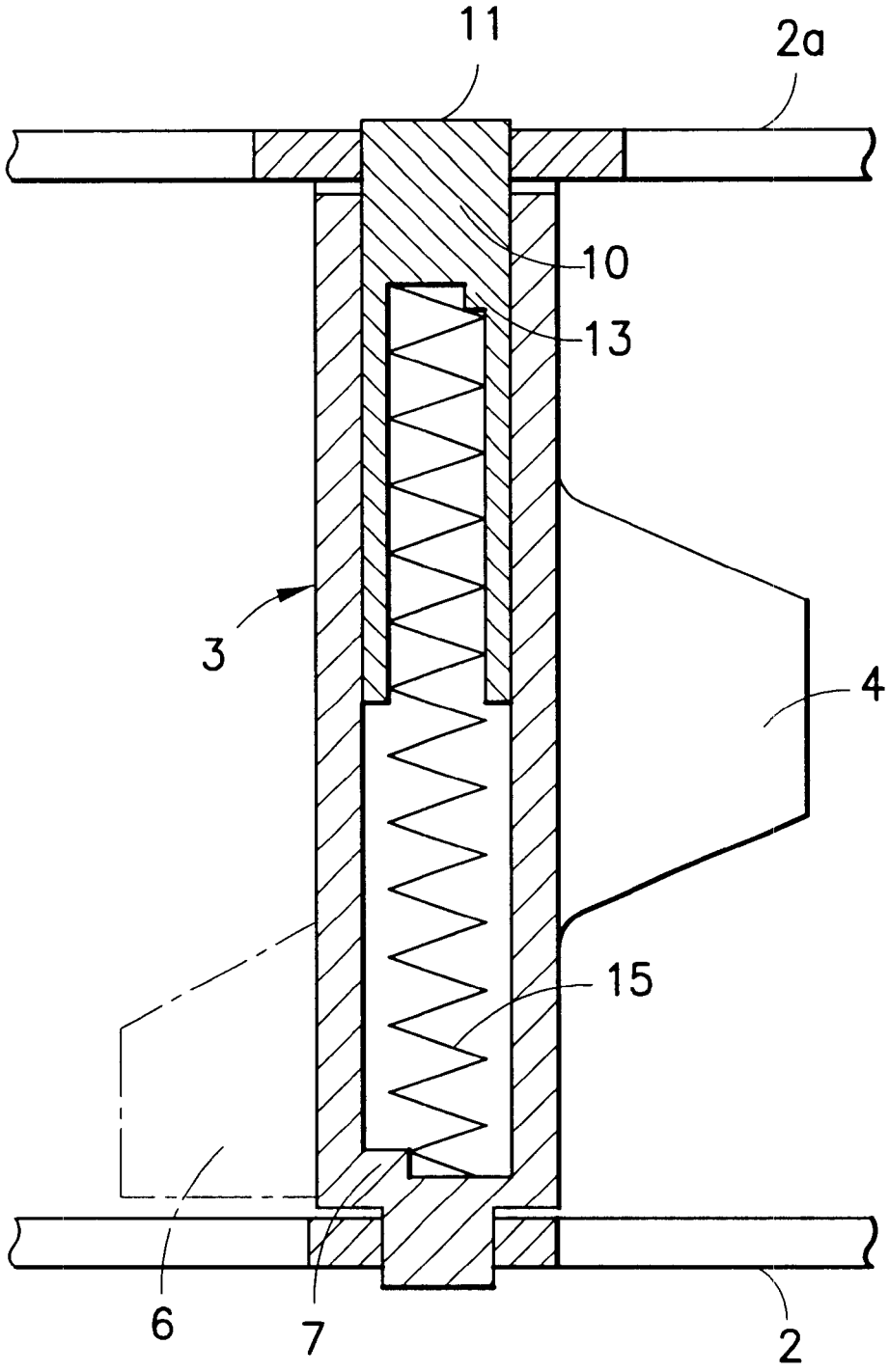
FIG. 4 is a sectional view taken along line B—B in FIG. 3.

FIG. 1 is a disassembling perspective view of a major part of the present invention, FIG. 2 is a rear view showing the assembled state of the present invention, FIG. 3 is a sectional view taken along line A—A in FIG. 2 showing the state that a locking member is locked with a saw-toothed fixed member which is adhered to a belt, and FIG. 4 is a sectional view taken along line B—B in FIG. 3 showing the state that a spring is coupled inside an operating rod.

As illustrated in FIG. 1, an operating rod (3) is basically a pipe-like shape of which one end portion is closed, wherein an inclined protruding plate (4*a*) of which end portion is slightly slanted downward is formed on the circumferential surface prominently forming an overally "]" shaped locking knob (4), a push knob (6) for releasing the fastened state of a belt is prominently formed on the lower part opposite to the locking knob, a spring locking portion (7) for locking with end portion of the spring is formed on the lower surface inside the operating rod, a "]" shaped cutout locking member (8) is formed on the upper portion upper the locking knob, and a fixed shaft (9) for rotating the operating rod by inserting the operating rod (3) into coupling holes formed on a frame (2) of a buckle body is formed on the lower part thereof.

A fixed rod (10) is a pipe shape of which external diameter is smaller than internal diameter of the operating rod and one end portion thereof is closed, wherein the fixed rod (10) is inserted and coupled to an opening of the operating rod (3), a fixed rectangular protrusion (11) for inserting into a coupling hole which is formed on top wall of frame (2*a*) of a buckle body is formed on one end portion of the fixed rod, formed on the circumferential surface thereof is a blocking projection (12) which is inserted into the cutout locking member (8) of the operating rod such that the fixed rod can not be outthrusted or rotated by forces of the spring (15), a spring locking portion (13) for locking with one end portion of the spring is formed on the lower part inside the fixed rod.

Functioning and interrelationship of each components are described as follows. A spring (15) is inserted into the operating rod (3) so as to fit the fixed rod (10) into the operating rod (3) such that end portion of an inclined protruding plate (4*a*) of the operating rod (3) is always contacted with the back side of a buckle body or a saw-thoothed member of a belt, and the inclined protruding plate can be returned to the original position when a push knob (6) is pressed and released for unfastening a belt.

One end portion of the wound spring is locked with the spring locking portion (7) of the operating rod and other side of end portion is locked with the spring locking portion (13) of the fixed rod when a user starts rotating the fixed rod (10) counter-clockwise in the state that the spring is somewhat pressed by pushing the fixed rod (10) after inserting the spring into the operating rod, wherein the buckle is assembled by pushing the fixed rod (10) such that the locking projection (12) which is formed on the circumferential surface of the fixed rod (10) can be inserted into the cutout locking member (8) which is formed on upper part of the operating rod as maintaining the state that restoring forces returning to the original wound condition are occurred to the spring by rotating the fixed rod certain number of times.

At this time, the length of an intact spring should be longer than that between the spring locking portion (7) which is formed inside the operating rod and the spring locking portion (13) which is formed inside the fixed rod to an appropriate extent, the length of an assembled member of the operating rod and the fixed rod should be longer than a width between top and bottom walls of frame by a certain length required for fitting the assembled operating rod into bottom of wall of frame (2). That is closely related with a depth of the cutout locking member (8) which is formed on upper part of the operating rod.

The blocking projection (12) which is formed on the circumferential surface of the fixed rod in a coupled member of the operating rod (3) and the fixed rod (10) is funtioned to deter the fixed rod (10) being returned counterclockwise by elasticity applied to the spring, thereby playing a role of maintaining the restoring force which is applied to the spring (15).

Next, as effects of the spring (15) inserted inside the operating rod and differences between degrees of an angle of the fixed rectangular protrusion (11) which is formed on one end portion of the fixed rod and those of coupling holes which are formed on the top and bottom walls of frame of the buckle body with a coupling member of the operating rod (3) and the fixed rod (10) fitted into two coupling holes which are formed on the top and bottom walls of frame of the buckle body, described is that end portion of the inclined protruding plate (4*a*) of the operating rod is always contacted with back surface of the buckle or saw-toothed grooves (21) of the belt.

A method for fitting a coupled member of the operating rod and the fixed rod into the buckle body is first inserting a fixed shaft (9) of the operating rod into a bottome wall of frame (2) since a length of the coupled member of the operating rod and fixed rod is longer that a width between a top wall of frame (2*a*) and a bottom wall of frame (2), and then pushing the fixed rod (10) to make its length short, thereby inserting the fixed rectangular protrusion (11) of the fixed rod into the rectangular coupling hole which is formed on the top wall of frame (2*a*).

At this time, a rectangular coupling hole formed on the top wall of frame (2*a*) is almost level with a buckle body (1) while the direction of the fixed rectangular protrusion is deviated from that of the coupling hole such that the fixed rectangular protrusion can be fitted into the coupling hole only when it is further rotated counter-clockwise by a certain degrees of an angle, i.e., resulting in the further strengthening of restoring forces applied to the spring.

Therefore, in the state that both end portions of the spring are locked with a spring locking portion (7) inside the operating rod and a spring locking portion (13) inside the fixed rod, and a blocking projection (12) formed on the circumferential surface of the fixed rod deters the fixed rod from being returned by restoring force of the spring, the fixed rod is further rotated counterclockwise clockwise by a certain degrees of an angle in the process of fitting the operating rod into the frame of the buckle body, the operating rod on one end portion of which a rotatable fixed shaft (9) is formed is rotated by the influence of the spring restoring force since the fixed rod can not rotate due to the fixed rectangular protrusion which is formed on one end portion of the fixed rod.

Therefore, the end portion of the locking knob is always contacted with the back surface of a buckle body or saw-toothed grooves of a belt since the locking knob which is unitedly protruded and formed on the circumferential surface thereof is rotated together with the operating rod when it is rotated.

An inclined protruding plate (4*a*) of the operating rod which is contacted with the back surface of a belt is inserted into the buckle in the state that the contact with saw-toothed grooves is maintained along the oblique surface of the saw-toothed grooves which are formed on the back surface of the belt as being lifted by the belt if end portion of the belt (20) is pushed into lower part of the operating rod (3) in case of fastening a belt (20) using the assembled buckle while a "]" shaped locking knob (4) is locked and can not be pulled out of vertical walls of saw-toothed grooves (21) when a user trys to take the belt out of the buckle.

Thereafter, if a user pushes a push knob (6) prominently formed on an operating rod (3) toward a buckle body (1), the operating rod (3) is rotated, thus rotating a locking knob (4) inserted in saw-toothed grooves (21) of the belt (20) in the same direction accordingly such that the inclined protruding plate (4*a*) can be slipped out of the saw-toothed grooves (21), thereby unfastening the belt as illustrated in FIG. 3 when a user wants to release the fastened state of a belt (20).

As described in the above, a buckle according to the present invention is useful. Production costs can be reduced since number of component parts of a buckle has been decreased. Unfastening of a belt contrary to a user's intention can be prevented since a buckle is designed such that a push knob (6) for unfastening the buckle at the rear side of a buckle body (1) can be operated. Above all, productivity has greatly been improved by simplifying structure of a buckle, thus hightening workability at the production site.

In this disclosure, there is shown and described only the preferred embodiment of the invention, but, as aforementioned, it is to be understood that the invention is capable of use in various other combinations and environments and is capable of changes or modification within the scope of the inventive concepts as expressed herein.

What is claimed is:

1. A buckle comprising:

a buckle body from the back of which top and bottom walls of buckle frame forming coupling holes are projected on the opposite points;

an operating rod which is inserted into the coupling holes formed on top and bottom walls of the buckle frame, wherein a cutout locking member, a locking knob coupled to saw-toothed grooves of a belt, and a push knob for releasing the coupling state of the locking knob are formed on the circumferential surface, a fixed shaft is formed on one end portion, and a spring locking portion is equipped inside thereof;

a fixed rod which is coupled to one end portion of the operating rod, wherein a blocking projection inserted into the cutout locking member of the operating rod is formed on the circumferential surface, a fixed rectangular protrusion is formed on one end portion, and a spring locking portion is equipped inside thereof; and a spring for providing the operating rod with rotating elasticity by being inserted into the operating rod.

* * * * *